United States Patent [19]

Raskin et al.

[11] 4,340,807

[45] Jul. 20, 1982

[54] OPEN LOOP FUSER CONTROL

[75] Inventors: Jerome S. Raskin, Newport Beach; Warren L. Hall, Rancho Palos Verdes, both of Calif.; Charles P. Holt, Fairport; Gerald E. Carlson, Webster, both of N.Y.

[73] Assignee: Xerox Corporation, Stamford, Conn.

[21] Appl. No.: 111,048

[22] Filed: Jan. 10, 1980

[51] Int. Cl.[3] ..... H05B 1/02

[52] U.S. Cl. ..... 219/497; 219/216; 219/501; 323/299; 323/300

[58] Field of Search ..... 219/216, 212, 497, 492, 219/501, 507, 508, 494; 323/298, 299, 300, 303; 355/14 FU, 3 FU; 307/117

[56] References Cited

U.S. PATENT DOCUMENTS

| | | | |
|---|---|---|---|
| 3,553,428 | 1/1971 | McGhee | 219/501 |
| 3,781,516 | 12/1973 | Tsilibes et al. | 219/497 |
| 3,878,358 | 4/1975 | Barton et al. | 219/497 |
| 3,921,058 | 11/1975 | Tanaka et al. | 323/300 |
| 3,961,236 | 6/1976 | Rodek et al. | 219/497 |
| 4,093,908 | 6/1978 | Evans | 323/300 |
| 4,130,753 | 12/1978 | Wade | 219/492 |
| 4,168,476 | 9/1979 | Petrizio | 323/300 |
| 4,282,422 | 8/1981 | Payne et al. | 219/492 |

*Primary Examiner*—B. A. Reynolds
*Assistant Examiner*—M. H. Paschall

[57] ABSTRACT

A controller having dedicated fuser circuitry and a processor for controlling the fuser heating element. The dedicated fuser circuitry interconnects an input voltage source to the processor through a low voltage power supply to provide a reference signal and a sample DC voltage signal representative of the input voltage source. The processor provides a digital signal to activate a triac connected to the fuser heating element. The triac, selectively gates the input voltage source across the heating element. A plurality of ranges of digital signals and a plurality of corresponding triac activation rates are provided for variations in input voltage. A digital signal related to a particular value of the input voltage source lies within one of the plurality of ranges determining the particular activation rate of the triac.

10 Claims, 10 Drawing Figures

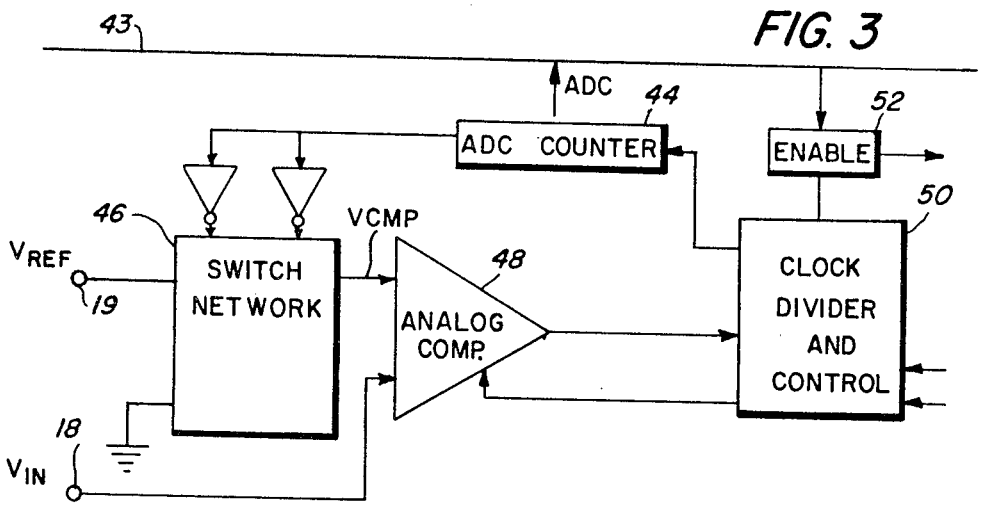
FIG. 3
FIG. 5A
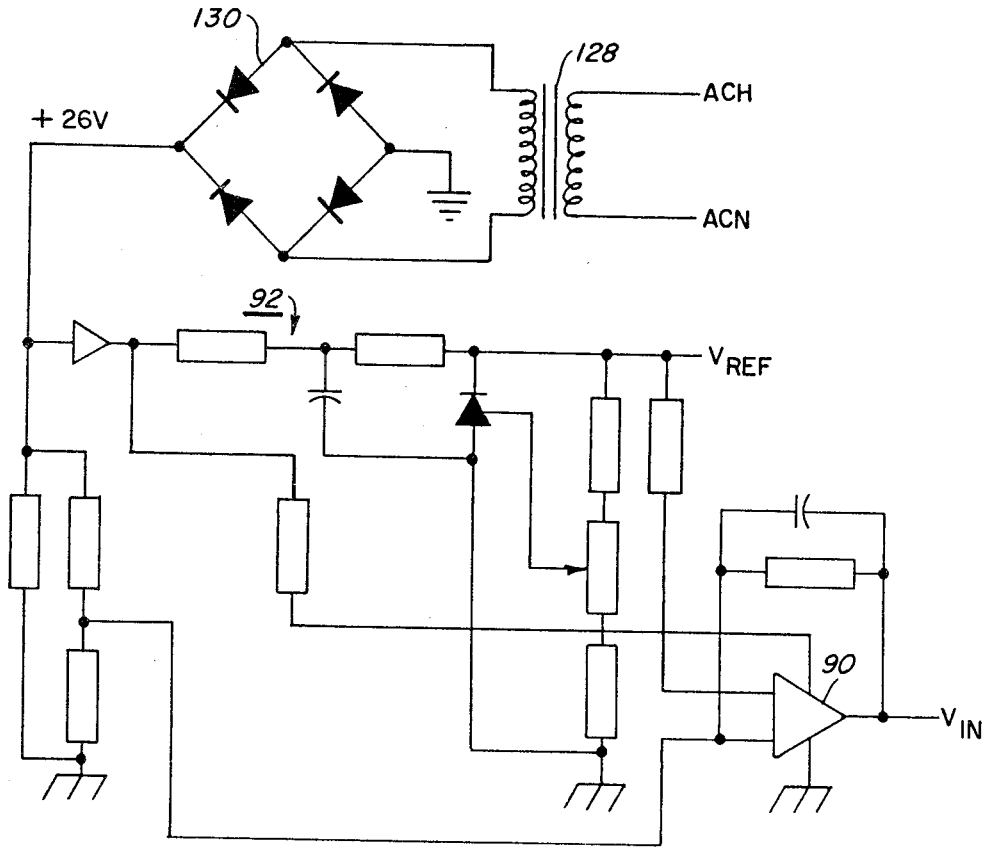

ACH
115 V
ACN
LVPS
DCTD CKT
$V_{REF}$
$V_{IN}$
ADC
POWER-UP RESET
PAT 1
PAT 2
ZERO CROSS
CLK OUT
E PROM
DUAL COUNTER
OCTAL BFR DVR
TTF
COOLING FAN
TRIAC
PRF DVR
LATCHES 4Q
FUSER HEAT LAMP
TRIAC
PRF DVR
DRIVER
LATCHES
LATCHES
TRANS
DRIVER
BUFFER
SWITCHES
SENSORS

REGISTER BINARY PATTERNS

FIG. 8

| PAT 2 | | ACTIVATION RATE | PAT 1 | |
|---|---|---|---|---|
| F | F | | F | F |
| 1111 | 1111 | 16/16 | 1111 | 1111 |
| F | F | | F | E |
| 1111 | 1111 | 15/16 | 1111 | 1110 |
| F | E | | F | E |
| 1111 | 1110 | 14/16 | 1111 | 1110 |
| F | D | | D | E |
| 1111 | 1101 | 13/16 | 1101 | 1110 |
| E | E | | E | E |
| 1110 | 1110 | 12/16 | 1110 | 1110 |
| D | B | | 7 | 6 |
| 1101 | 1011 | 11/16 | 0111 | 0110 |
| A | D | | D | 6 |
| 1010 | 1101 | 10/16 | 1101 | 0110 |
| A | A | | D | 6 |
| 1010 | 1010 | 9/16 | 1101 | 0110 |
| A | A | | A | A |
| 1010 | 1010 | 8/16 | 1010 | 1010 |

OPEN LOOP FUSER CONTROL

This invention relates to a control for the fuser of electrostatic type reproduction machines, and more particularly to a control for providing a regulated input to the fuser heater.

In electrostatic type reproduction machines, a toner image of the original document being copied is electrostatically formed on a copy sheet. In order to render the image permanent, the image is fused by passing the copy sheet through a heating station, conventionally called a fuser, to fuse the toner onto the copy sheet. In machines of this type, correct fuser temperatures are critical. If the fuser temperature is too low, fusing may be incomplete as evidenced by smearing and loss of image. If the fuser temperature is too high, there is the likelihood that the copy sheet may burn or scorch.

Many fusers employ an electric heating element, for example, a heating lamp as a heat source. The heat source is usually connected to the line voltage source and if the line voltage varies beyond the acceptable limits for the fuser lamp, fuser temperatures may change resulting in improperly fused copies.

It is known in the prior art to control the power input to a heating lamp irrespective of variations in line voltage. For example, U.S. Pat. No. 3,881,085 assigned to the same assignee as the present invention teaches the use of a heating lamp connected to a power source by a suitable switch such as a silicon controlled rectifier SCR. Line voltages across the heating lamp are constantly monitored by a transformer. The output of the transformer charges a capacitor in order to switch an amplifier to the conductive state. Switching the amplifier to the conductive state, in turn, inhibits the silicon controlled rectifier for interrupting power to the heating lamp to compensate for variations in line voltage.

Other prior art control systems such as U.S. Pat. No. 3,735,092, also assigned to the same assignee as the present invention, teach the use of a thermistor providing a signal in response to changes in fuser temperature. The signal is conveyed to a switching amplifier. When the switching amplifier is triggered to a conducting state, a switch is closed completing the circuit to the fuser heat lamp. The switching of the amplifier to the non-conducting state opens the switch to interrupt power to the fuser lamp and the switching amplifier is biased to provide a specific switching response through suitable resistor combinations.

Prior art systems also include U.S. Pat. No. 3,532,885 showing the use of a step down transformer connected to a power supply to a heating lamp and providing an output to a power regulating circuit also receiving a feedback signal representing the voltage across the heat lamp. The power regulating circuit responds to the output transformer and the feedback signal triggers a thyristor controlling line voltage across the fuser lamp.

A difficulty with these types of systems is the need to monitor relatively high line voltages or the need to change circuit elements such as capacitors and resistors to be able to vary the parameters of control.

Another method of control is a sampling technique in which the voltage across the heating element is sampled by a light bulb. The emitted light from the light bulb is proportional to R.M.S. voltage across the lamp. A photodetector converts the light into a direct current voltage for controlling a switch and a triac. The triac is gated in order to remove cycles of alternating current across the lamp to regulate R.M.S. voltage across the lamp.

A disadvantage of this type of system is that the control is also at a relatively high voltage level and specific to the sensing of a predetermined state of the fuser, for example, the voltage across the heating lamp. Another disadvantage is that the light bulb degrades with time and is also sensitive to ambient temperature changes.

It would, therefore, be desirable to provide a reliable control system to regulate the R.M.S. voltage across a fuser element. It would also be desirable to provide a control system that is independent of feedback and that is readily modified to respond to a variety of parameters. It would also be desirable to provide a relatively low, isolated sense voltage level for control.

Accordingly, it is an object of the present invention to provide an improved controller providing a versatile control of a fuser heating element without the use of feedback circuits. Further advantages of the present invention will become apparent as the following description proceeds, and the features characterizing the invention will be pointed out in the claims annexed to and forming a part of this specification.

Briefly, the present invention is concerned with a controller having dedicated fuser circuitry and a processor for controlling the fuser heating element as one element in its overall control of a reproduction machine. The dedicated fuser circuitry interconnects an input voltage source to the processor through a low voltage power supply to provide a reference signal and a sample DC voltage signal representative of the input voltage source. The processor provides a digital signal to activate a triac connected to the fuser heating element. The triac, selectively gates the input voltage source across the heating element. A plurality of ranges of digital signals and a plurality of corresponding triac activation rates are provided for variations in input voltage. A digital signal related to a particular value of the input voltage source lies within one of the plurality of ranges determining the particular activation rate of the triac.

BRIEF DESCRIPTION OF THE DRAWINGS

For a better understanding of the present invention, reference may be had to the accompanying drawings, wherein the same reference numerals have been applied to like parts and wherein:

FIG. 3 is a schematic diagram of the analog to digital conversion circuitry of the controller shown in FIG. 2;

FIGS. 5*a*, 5*b* and 5*c* are schematic diagrams of details of the controller shown in FIG. 2.

FIG. 8 is a register content layout in accordance with the procedure shown in FIG. 7.

DESCRIPTION OF THE INVENTION

Figure 1:
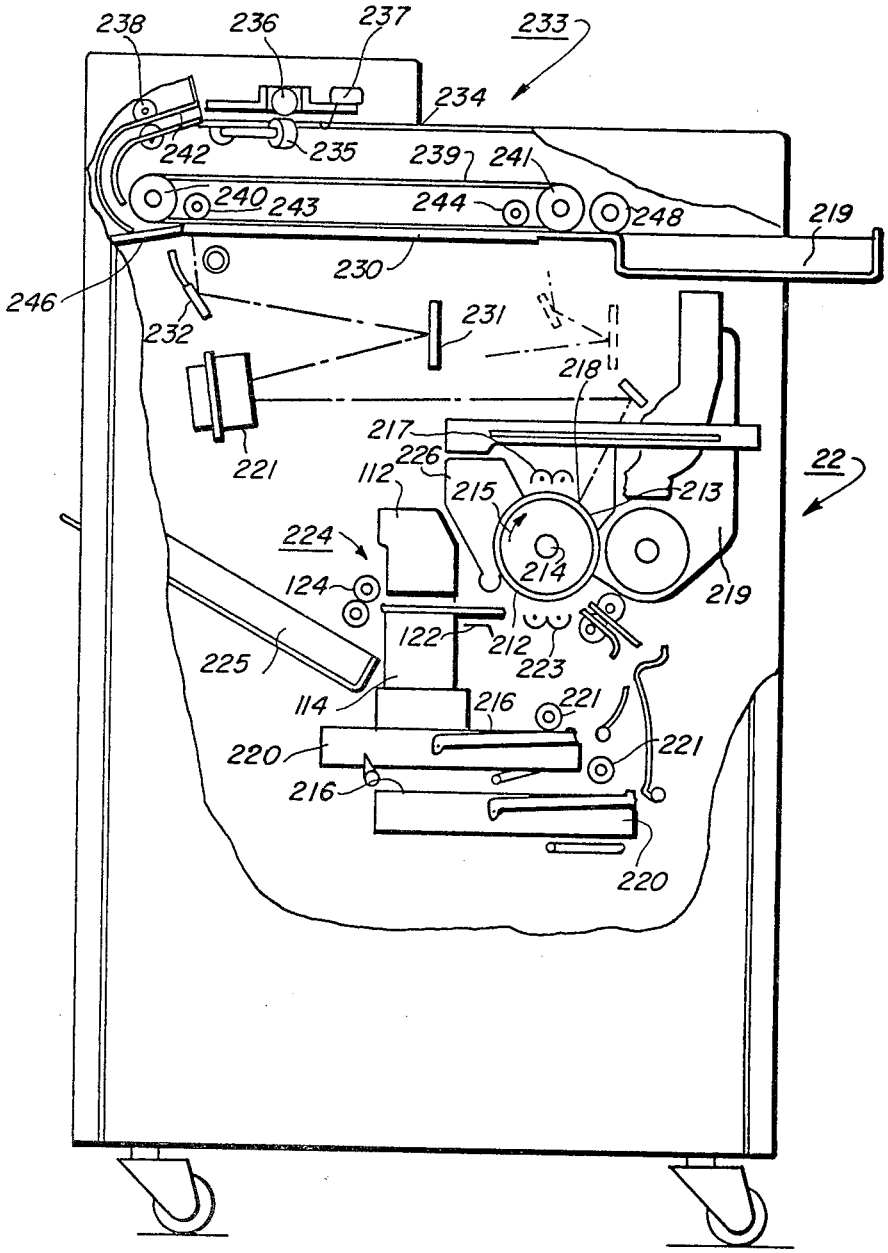
FIG. 1 is a representation of a reproducing apparatus incorporating the present invention.

Referring now to FIG. 1 there is shown by way of example an automatic xerographic reproducing machine 22 including an image recording drum-like member 212, its outer periphery coated with a suitable photoconductive material or surface 213. The drum 212 is suitably journaled for rotation within a machine frame (not shown) by means of shaft 214 and rotates in the direction indicated by arrow 215 to bring the image-bearing surface 213 thereon past a plurality of xerographic processing stations. Suitable drive means (not shown) are provided to power and coordinate the motion of the various cooperating machine components whereby a faithful reproduction of the original input scene information is recorded upon a sheet of final support material or copy sheet 216.

Initially, the drum 212 moves the photoconductive surface 213 through a charging station 217 providing an electrostatic charge uniformly over the photoconductive surface 213 in known manner preparatory to imaging. Thereafter, the drum 212 is rotated to exposure station 218 and the charged photoconductive surface 213 is exposed to a light image of the original document to be reproduced. The charge is selectively dissipated in the light exposed regions to record the original document in the form of an electrostatic latent image. After exposure drum 212 rotates the electrostatic latent image recorded on the photoconductive surface 213 to development station 219 wherein a conventional developer mix is applied to the photoconductive surface 213 of the drum 212 rendering the latent image visible. Typically a suitable development station could include a magnetic brush development system utilizing a magnetizable developer mix having coarse ferromagnetic carrier granules and toner colorant particles.

Sheets 216 of the final support material are supported in a stack arrangement on an elevating stack support tray 220. With the stack at its elevated position a sheet separator 221 feeds individual sheets therefrom to the registration system 222. The sheet is then forwarded to the transfer station 223 in proper registration with the image on the drum. The developed image on the photoconductive surface 213 is brought into contact with the sheet 216 of final support material within the transfer station 223 and the toner image is transferred from the photoconductive surface 213 to the contacting side of the final support sheet 216. Following transfer of the image the final support material is transported through a detack station where detack corotron 227 uniformly charges the support material to separate it from the drum 212.

After the toner image has been transferred to the sheet of final support material or copy sheet 216, the copy sheet 216 with the image is advanced to a suitable fusing station 224 for coalescing the transferred powder image to the support material. After the fusing process, the copy sheet 216 is advanced to a suitable output device such as tray 225.

Although a preponderance of toner powder is transferred to the copy sheet 216, invariably some residual toner remains on the photoconductive surface 213. The residual toner particles remaining on the photoconductive surface 213 after the transfer operation are removed from the drum 212 as it moves through a cleaning station. The toner particles may be mechanically cleaned from the photoconductive surface 213 by any conventional means as, for example, by the use of a cleaning blade.

Normally, when the copier is operated in a conventional mode, the original document to be reproduced is placed image side down upon a horizontal transparent platen 230 and the stationary original then scanned by means of a moving optical system. The scanning system includes a stationary lens 221 and a pair of cooperating movable scanning mirrors, half rate mirror 231 and full rate mirror 232 supported upon carriages not illustrated.

A document handler 233 is also provided including registration assist roll 235 and switch 237. When a document is inserted, switch 237 activates registration assist roll 235 and the document is fed forward and aligned against a rear edge guide of the document handler 233. The pinch rolls 238 are activated to feed a document around 180° curved guides into the platen 230 for copying. The document is driven by a platen belt transport including platen belt 239. After copying, the platen belt 239 is activated and the document is driven off the platen by the output pinch roll 248 into the document catch tray 249.

Figure 2:
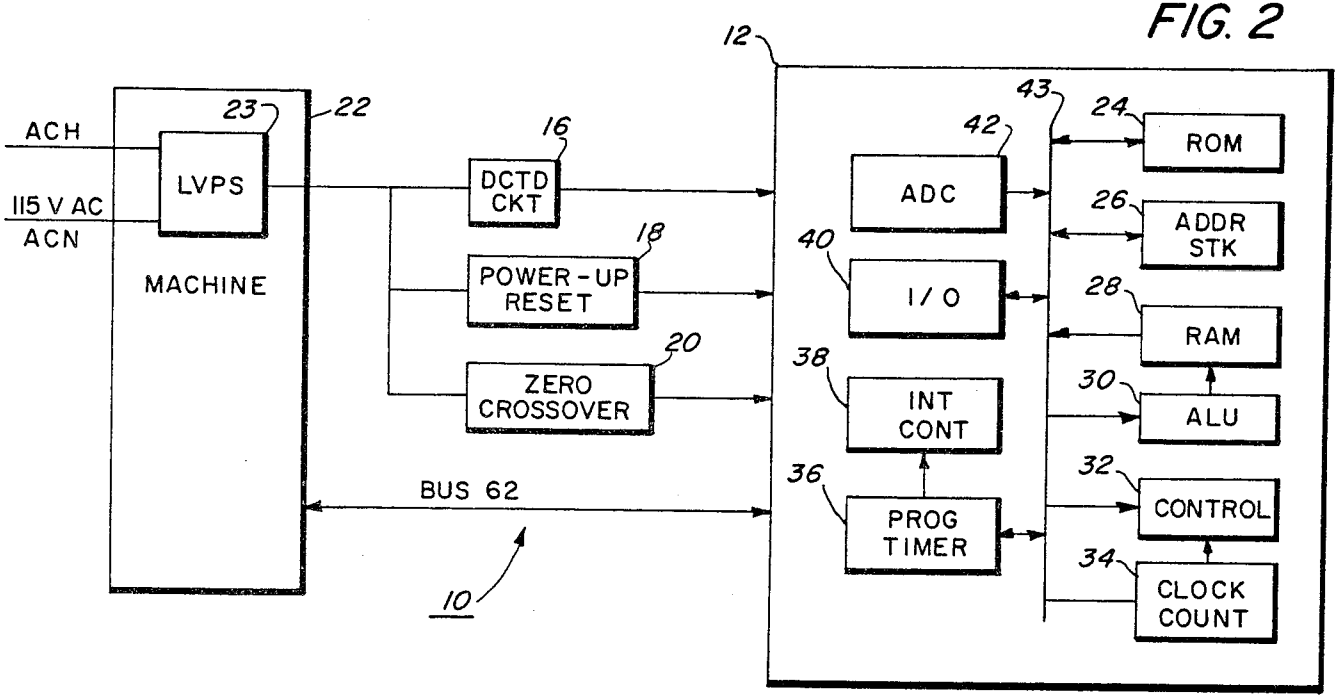
FIG. 2, is a general block diagram illustration of a controller and host machine in accordance with the present invention.

With reference to FIG. 2, there is shown a controller generally indicated at 10 including a bidirectional bus 62, microprocessor 12, dedicated circuitry 16, power up reset circuitry 18, and zero crossover circuitry 20 controlling reproduction machine 22 including a low voltage power supply 23 connected to an input line voltage source preferably 115 volts alternating current. Preferably, the microprocessor 12 includes a 2K by 8 read only memory ROM 24, address stack 26, 64 by 8 random access memory RAM 28, an 8 bit arithmetic logic unit ALU 30, control 32, clock counter 34, programmable timer 36, interrupt control 38, an 8 bit input-output port 40, and analog to digital converter ADC 42 interconnected to a common internal bus 43. The bidirectional bus 62 is shown interconnecting the microprocessor 12 and host machine 22 and generally conveys signals from sensors and switches of machine 22 to microprocessor 12 and conveys control signals from microprocessor 12 to machine 22.

Figure 4:
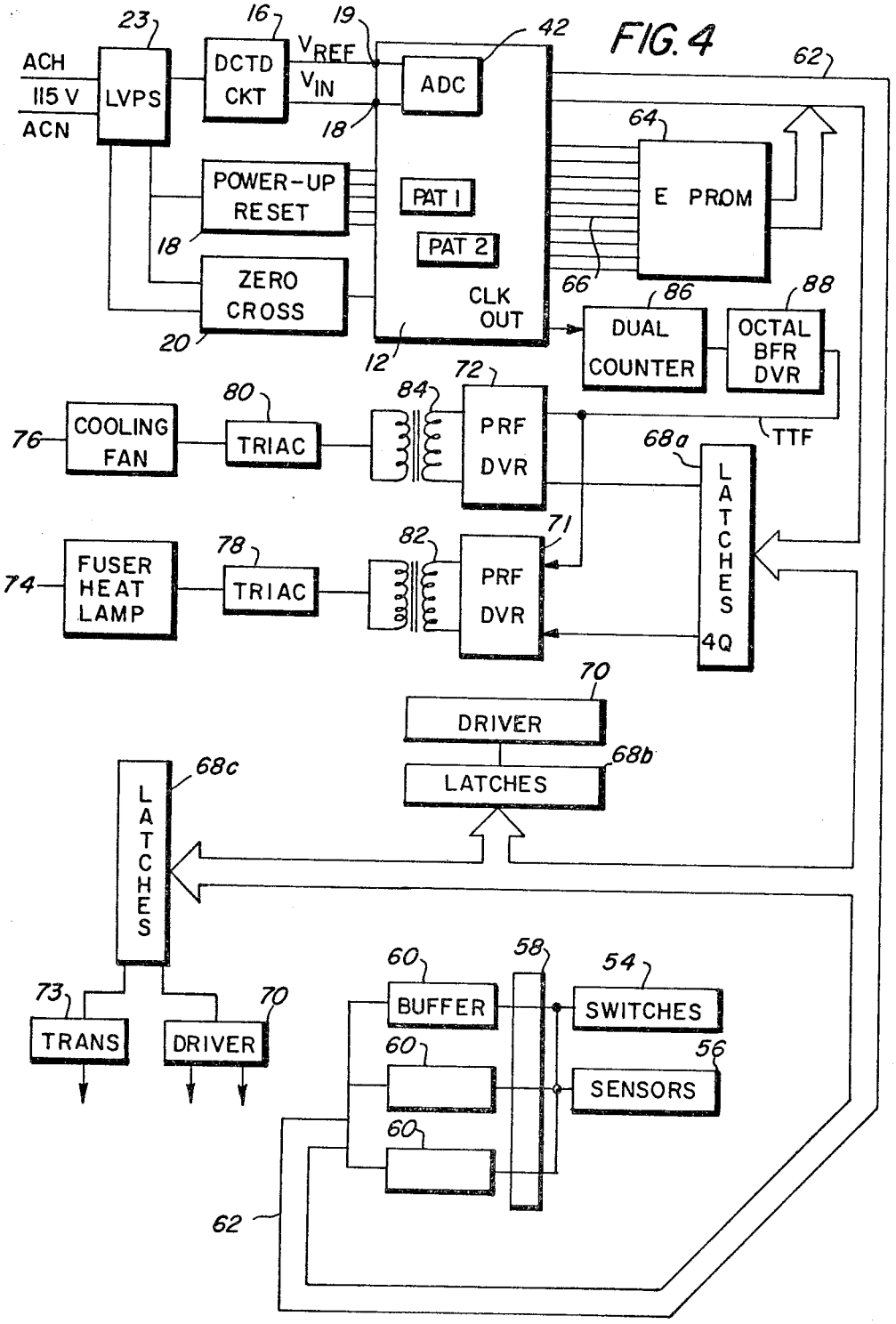
FIG. 4 is a block diagram of the controller in accordance with the present invention.

In accordance with the present invention, the microprocessor 12 is also connected to an alternating current input line voltage source, illustrated by lines ACH and ACN, through unregulated low voltage power supply 23 and dedicated fuser circuitry 16. Dedicated circuitry 16 processes signals from the low voltage power supply 23 of the machine 22 to the analog to digital converter 42 of microprocessor 12 as illustrated in FIG. 4. These signals are used by microprocessor 12 to selectively control fuser station 224 in particular fuser heat lamp 74.

With reference to FIG. 3, analog to digital converter ADC 42 comprises a 6 bit counter 44, a switching network 46, an analog comparator 48, and clock divider and control 50 with suitable clock signals for a 6 bit digital output. At the beginning of the conversion sequence, an enable flip-flop 52 gates on the clock divider and control 50 causing the 6 bit counter 44 to count up. The digital values in the counter 44 are applied to the switching network 46 through suitable gates in combination with a reference voltage $V_{REF}$ setting up a voltage divider combination that produces an analog output signal VCMP. The output signal VCMP is a fraction of the input reference voltage $V_{REF}$ as determined by digital value in the counter 44 applied to switching network 46. The output of the network 46 provides one input to analog comparator 48.

The second input to the analog comparator 48 is the unknown input voltage $V_{IN}$. The conversion can be any suitable procedure such as the following. If voltage $V_{IN}$ is greater than voltage VCMP, counting continues. The compare voltage VCMP, in analog form, is equivalent to the count in the 6 bit counter 44. An increment of one bit in the counter causes an increment of one analog unit or 62.5 millivolts in VCMP. When voltage $V_{IN}$ becomes less than voltage VCMP, conversion is complete and the digital value in the counter is within one bit value of the analog input $V_{IN}$. The enable flip-flop 52 is reset and the clock divider and control 50 gated off. The contents of the counter 44 representing the digital equivalent of voltage $V_{IN}$ are then transferred via the internal data bus 43 within the microprocessor 12. For a more detailed discussion of microprocessor 12 including ADC 42, reference is made to Ser. No. 080,624, filed Oct. 1, 1979 incorporated herein. It should be noted that while this application uses a count and switch A/D technique, the implementation may actually use any A/D converter with the accuracy of conversion related to the accuracy of control.

With reference to FIGS. 4, 5*a*, 5*b* and 5*c*, the signals of various reproduction machine switches 54 and sensors 56 are conveyed through a resistance network 58 and suitable buffers 60 to an 8 bit external data bus 62 connected to microprocessor 12. Typically, the resistance network 58 is any standard dual inline package configuration of thick film elements baked onto a ceramic substrate, terminated with wire leads and providing resistance in the range of 22 ohms to 220K ohms. Buffers 60 are preferably octal buffers and line drivers with three state outputs. The 8 bit data bus 62 is also connected to a suitable memory device such as EPROM 64 interconnected to microprocessor 12 through suitable address lines 66. It should be noted that the EPROM device 64 can be replaced by a suitable read only memory ROM 64 internal to the microprocessor 12.

Outputs to the reproduction machine controlled elements are conveyed from the microprocessor 12 along the external data bus 62 to various latches 68*a*, 68*b* and 68*c*. The latches are preferably Schotky TTL octal d-type flip-flops and are interconnected to various drivers 70, 71 and 72, or transistors 73 to activate various clutches, solenoids, motor drives, triacs and power supplies in machine 22. Typical drivers 70 are high voltage, high current Darlington transistor arrays with high breakdown voltage and internal suppression diodes. Preferably, drivers 71 and 72 are peripheral NAND gates. In particular, the reproduction machine 22 includes fuser heat lamp 74 and fuser cooling fan 76 connected to the input voltage source and activated by triacs 78 and 80 through transformers 82 and 84, respectively.

The special dedicated fuser circuitry, 16, provides a voltage reference signal $V_{REF}$ at pin 19 of the microprocessor 12 and a sample voltage $V_{IN}$ at pin 18 of the microprocessor. In particular, the sample voltage $V_{IN}$ is a direct current voltage whose magnitude is proportional to the input line voltage magnitude. It is conveyed to analog to digital converter 42 and converted to an equivalent digital signal by converter 42. Microprocessor 12 then relates the AC input line voltage to the equivalent digital signal and controls the average RMS voltage across fuser heat lamp 74 by selective activation of triac 78 gating the AC line voltage across the fuser heat lamp 74.

In other words, the input line voltage is sampled, $V_{IN}$, via dedicated circuitry 16 to provide the control of the triac 78 to produce a relatively constant average RMS line voltage across fuser heat lamp 74 regardless of variations in the input line voltage. Specifically, the microprocessor 12 responds to the digital equivalent of $V_{IN}$ in counter 44 of ADC 42 to selectively activate triac 78. For example, assume 101 RMS input line voltage provides a desired average 101 volts RMS across fuser heat lamp 74. A 115 RMS input line voltage would produce an average RMS voltage across heat lamp 74 greater than 101 volts. Therefore, at 115 volts RMS input, it is necessary to inhibit or steal selected AC cycles through the fuser heat lamp 74 to achieve an average 101 volts RMS across the fuser heat lamp 74. This is achieved by the selective gating of triac 78 to inhibit selected input voltage cycles across the fuser heat lamp 74.

With further reference to FIGS. 4, 5*a*, 5*b* and 5*c*, in particular embodiment, there is pulse train generation circuitry connected to the microprocessor 12 including a dual 4 bit binary counter 86 receiving clock out signals from the microprocessor 12 and an octal buffer and driver 88. The counter 86 counts down the clock out signal producing a suitable periodic signal conveyed to the octal buffer and driver 88. The output of the driver 88 provides a pulse train TTF to peripheral driver 71 and the other input to the peripheral driver 71 is the output of pin 4Q of latch 68*a*. The output of pin 4Q going high, enables driver 71 and the output of the driver 71 activates triac 78 through transformer 82. In effect, the combination of the pulse train TTF and the output from pin 4Q of the octal latch 68*a* in response to data from the microprocessor 12 over the data bus 62, generates an output from the driver 71 activating triac 78. The driver 71 activating triac 78 determines the duty cycle or degree of activation of the fuser heat lamp 74. In effect, an open loop control of the fuser heat lamp 74 is provided without the necessity of a sensor and feedback signal.

Figure 6:
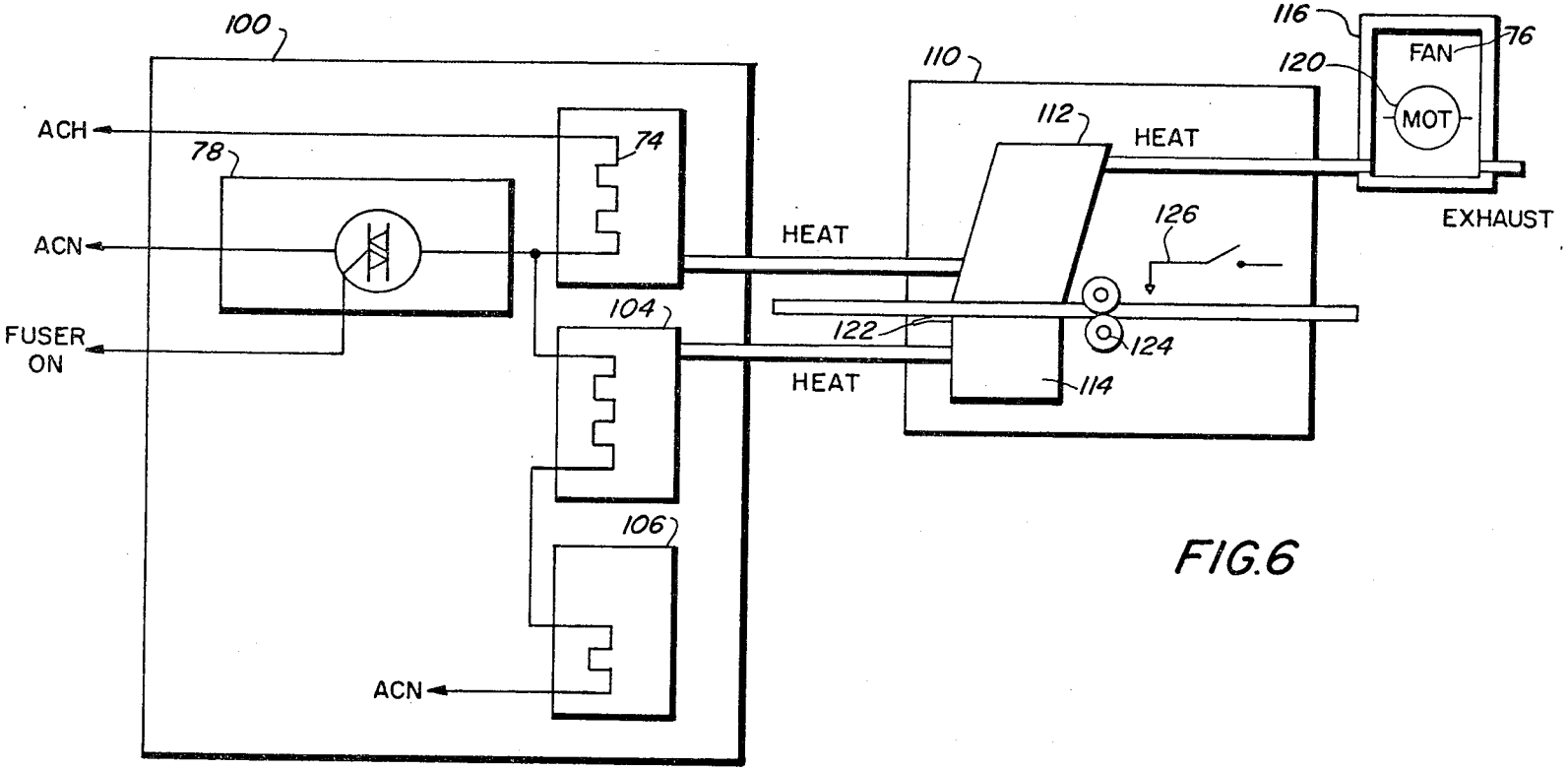
FIG. 6 is a schematic diagram of the triac control of the fuser elements.

For a clearer understanding of the control of the fuser station 224, the fuser station is shown schematically in FIG. 6 as three components, the fuser heat control component 100 including fuser triac 78, fuser heat lamp 74, base heater 104, and base heater thermostat 106, the copy fusing and transportation component 110 including upper fuser 112, lower fuser or base 114 and the air supplying component 116 including cooling fan 76 and motor 120. It should be understood, however, that fuser heat lamp 102 and base heater 109 are an integral part of the upper fuser 112 and base 114, respectively and are shown separately for a clearer description.

Figure 5B:
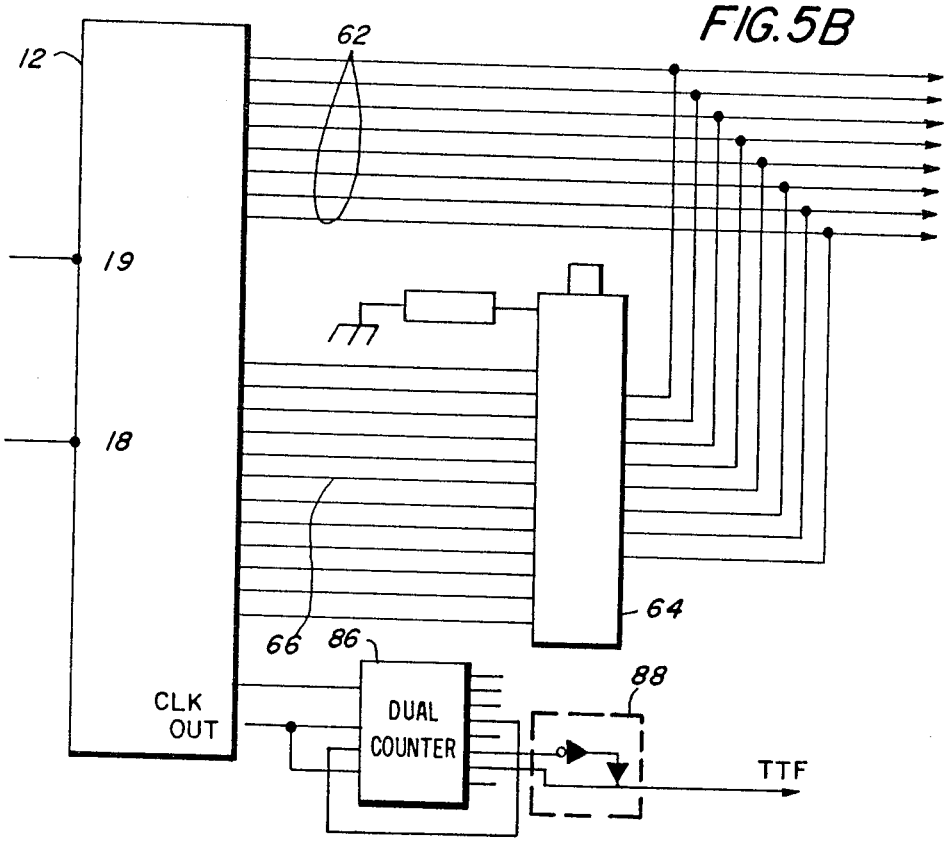
Figure 5C:
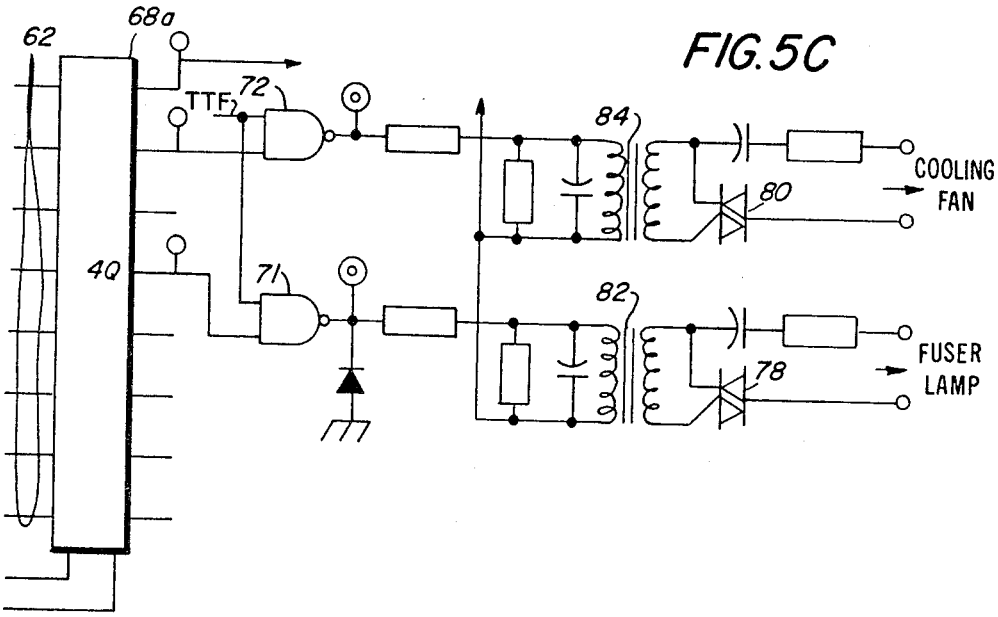

The fuser triac 78 activates the fuser heat lamp 74 providing the heat necessary to fuse the dry toner to the copy sheets 216. Enabling of the fuser triac 78 by the "Fuser on" signal provides input line voltage to the fuser heat lamp 74 as illustrated by lines ACH and ACN. The Fuser on signal is connected to transformer 82 activated by driver 71 as seen in FIGS. 4 and 5*c*. The upper fuser 112 includes the fuser heat lamp 74 and as illustrated in FIG. 6, heat is conveyed from the heating lamp 76 to the upper fuser 112. The lower fuser or base 114 is maintained at a given temperature level by base heater 104 housed in the lower fuser or base 114 and as illustrated in FIG. 6, heat is conveyed from base heater 104 to base 114.

A prefuser transport 122 attached to the upper fuser 112 supports copy sheets to be driven between upper fuser 112 and base 114. The unfused copy enters the fusing station 224 and toner is fused to the paper and the copy is then exited through feedout rollers 124 to exit tray 225 as seen in FIG. 1. To prevent overheating, the fan 76 with motor 120 exhausts excess heat from the upper fuser 112. Two overheat thermostats (not shown) on the upper fuser 112 connect one line input to the main drive motor of the machine and to the fuser heat lamp 74. If the fuser temperature exceeds approximately 177° C., the thermostats will open and remove line current from the main drive motor of the machine and the fuser lamp 74.

A not shown warmup thermostat controls the fuser on signal to the fuser triac 78 during warmup. During warmup of the fuser station 224, if the temperature is below 72° C., the normally closed contacts of the warmup thermostat cause the machine control 10 to switch on the fuser triac 78 and inhibit start print. As the fuser station 224 warms up and the temperature reaches 72° C., the contacts of the warmup thermostat will open and provide a fuser warm signal to the machine control 10. The machine control 10 will then switch off the fuser triac 78 and indicate that the machine is in a ready state.

During warmup, the fuser on signal allows the fuser triac 78 to control both the fuser heat lamp 74 and the base heater 104 simultaneously. The base heater 104, as illustrated in FIG. 6, is wired in series with the fuser heat lamp 74 and in parallel with the fuser triac 78. When fuser triac 78 is in the off state, current will flow from ACH through the fuser heat lamp 74, the base heater 104, and the base heater thermostat 106 to neutral or ACN. Most of the voltage will appear across the base heater 104 because its resistance is ten times greater than that of the fuser heat lamp 74. When the fuser triac 78 is in the one state, however, no current can flow through the base heater 106 because the fuser triac 78 forms a shunt across the base heater 104. Instead current flows through the fuser heat lamp 74 from ACH to ACN. During warmup, the fuser lamp 74 is switched on every other cycle (off every other cycle) and therefore the fuser heat lamp 74 and base heater 104 each operate at approximately ½ power.

The upper fuser 112 is the primary source of heat, approximately 90 percent, to fuse the image onto the copy sheet during a copy cycle. The base heater 106 maintains the temperature of the base 114 at about 130° C. at standby. Maintaining this temperature in standby allows the upper fuser 112 to reach the correct fusing temperature much faster before the copy gets to the fuser station 224. The lower fuser or base 114 supplies about 10 percent of the heat required to fuse the sheet as it passes between the upper and lower fuser 112, 114.

The mechanical drive for the feed out rollers 124 comes from the main drive motor through a belt, pulleys and coupling (not shown). When the fused sheet is transported out of the fuser by the feed out rollers 124, the lead edge of the sheet actuates a feed out switch 126 sending a sheet feed out signal to the machine control 10. The machine control 10 will stop the copy cycle, and display a status code if the lead edge of the sheet does not actuate the feed out switch 125 within 0.2 seconds from the time that the trail edge deactuates a (not shown) feed in switch.

Preferably, an average power output of approximately 1050 watts is provided by the fuser heat lamp 74 at an average 101 RMS voltage across the fuser heat lamp. In accordance with the present invention, a relatively constant average 101 RMS voltage across the fuser heat lamp 74 is maintained regardless of fluctuations of the input line voltage. In operation with a 101 RMS input line voltage, the continuous activation of the fuser triac 78 by the driver 71 for each complete cycle of input line voltage provides a relatively constant average 101 volts RMS across the fuser lamp 102 disregarding minimal system losses. If, on the other hand, input line voltage is greater than 101 volts RMS, the fuser triac 78 will not be activated for every complete cycle of input line voltage, and in effect some input line voltage cycles across fuser lamp 74 will be missed or stolen. By stealing or missing the appropriate number of input voltage cycles through lamp 74 by fuser triac 78 it is possible to produce a relatively constant average 101 volt RMS across the heating lamp 102 even though more than 101 volts RMS is applied.

As seen in FIG. 3, in accordance with the present invention, the sample voltage or voltage $V_{IN}$ at pin 18 is a DC voltage centered at approximately 5 volts over a range from 3 to 7 volts. $V_{IN}$ is provided by op amp 90 receiving a +26 volt input through suitable resistors from low voltage power supply 23 connected to input line voltage. The low voltage power supply includes a suitable step down transformer 128 and full wave voltage rectifier 130 as seen in FIG. 5*a*. The sample voltage $V_{IN}$ is therefore transformer isolated from input line voltages, full wave rectified and integrated resulting in a DC voltage at pin 18 related to the average value of input line voltage. The reference voltage $V_{REF}$ at pin 19 of microprocessor 12 is connected to the low voltage power supply 23 through stabilization circuitry 92 including suitable resistors and diodes. Pin 18 is connected to one input of analog comparator 48 and pin 19 is connected to the resistor switching network 46.

Since driver 71 is a NAND gate, the output of driver 71 will be low when the pulse train signals TTF, and the output from pin 4Q are both high. Essentially, the output of pin 4Q going low, provides a high signal output from the driver 71 and inhibits activation of the triac 78 through the transformer 82. That is, when 4Q is high, the triac 78 is gated on and when 4Q is low, the triac 78 is gated off. In effect, the output of the octal latch 68*a* going high determines the activation of the triac 78 or the duty cycle of the fuser lamp 74. By selectively gating the triac 78, the RMS voltage across the fuser lamp 74 is controlled.

The analog to digital converter 42 on the microprocessor 12 responds to voltage $V_{IN}$ and provides the digital equivalent. This digital equivalent is processed to determine the degree of activation of the fuser triac 78 required in order to maintain the average 101 volts RMS across the fuser heating lamp 74. In other words, microprocessor 12 relates the AC RMS voltage across the fuser lamp 74, as represented by the digital equivalent of $V_{IN}$, to the degree of activation of fuser triac 78 to maintain an average 101 volts RMS across fuser lamp 74.

In a preferred embodiment, it is desired to regulate voltage to the fuser heat lamp 74 to an average 101 volts RMS ±2.5 volts as line voltage varies from 101 to 140 volts RMS. Therefore, the microprocessor 12 responds to the analog to digital converter 42 output and provides at line frequency a serial digital output to the driver 71 to enable fuser triac 78 such that the average RMS voltage across the fuser heat lamp 74 will remain within 101 volts ±2.5 volts when integrated over 16 full cycles. During the line frequency cycle that the serial digital output is true, the full line voltage is applied across the fuser heat lamp 74 for that full cycle. When the serial digital output is false, the applied voltage across the fuser heat lamp 74 is zero for that particular full cycle.

In a preferred embodiment, a relationship between input line voltage, voltage across the fuser heat lamp 74 and the number of on cycles of the fuser triac 78 is the following:

$$V_{LAMP} = V_{LINE}\sqrt{\frac{P}{16}}$$

that is, $V_{LAMP}=V_{LINE}$ times the square root of P/16, where P equals the number of on cycles out of every 16 full cycles of the fuser triac 78 corresponding to input voltage cycles. The constant 16 is used in this particular embodiment because the procedure operates in groups of 16 full cycles. An alternative procedure would be $$V_{LAMP} = V_{LINE}\sqrt{\frac{P-N}{P}}$$

where P equals total cycles and N equals number of cycles removed.

Figure 7:
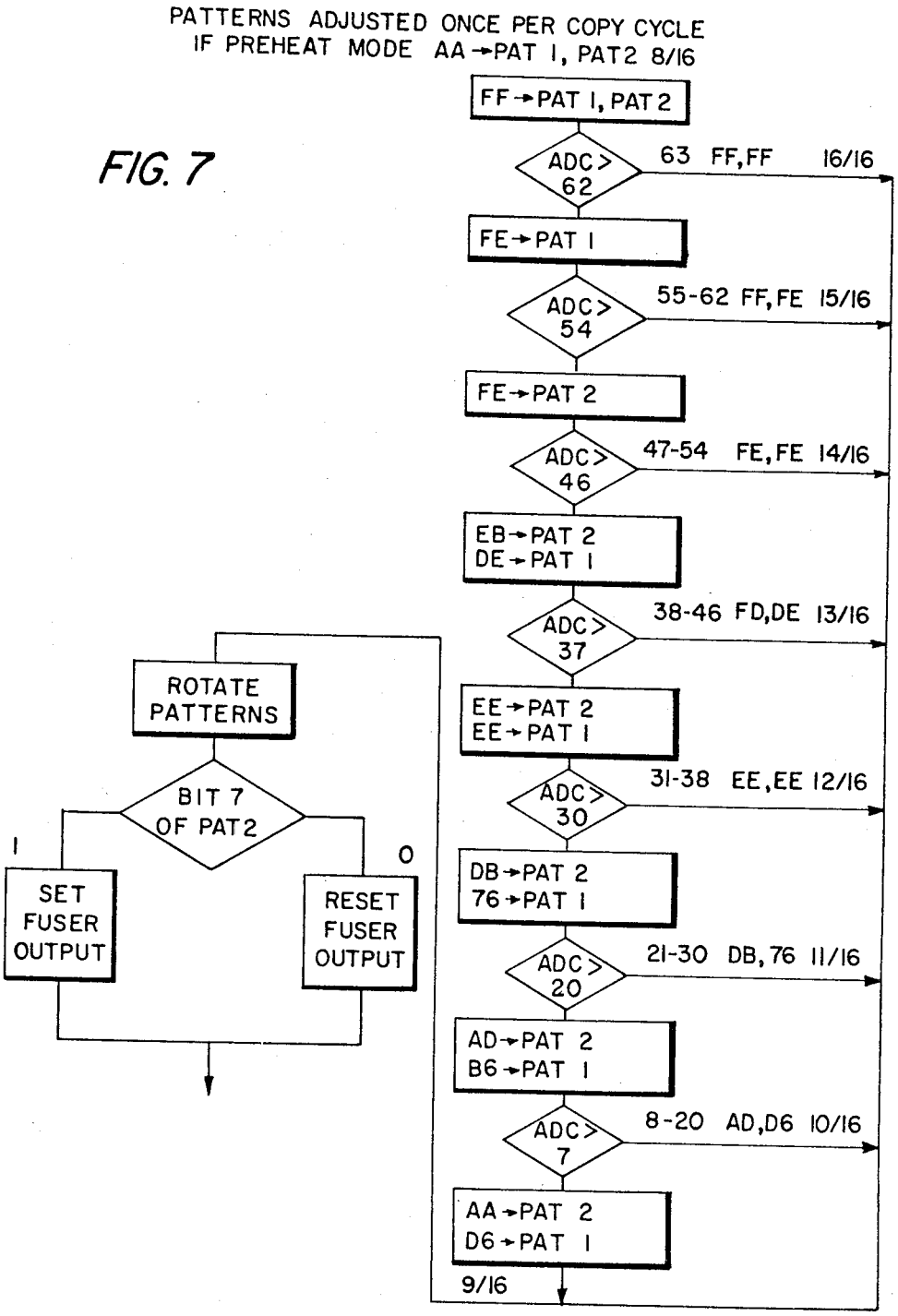
FIG. 7 is a flow chart of the triac activation procedure in accordance with an implementation of the present invention.

A flow chart implementing this relationship is shown in FIG. 7 in which the terms PAT1 and PAT2 represent 8 bit registers internal to the microprocessor 12 as shown in FIG. 4. The term ADC refers is the contents of the ADC counter 44 representing the digital equivalent of the voltage $V_{IN}$ at pin 18. The input line voltage is monitored once per copy cycle (approximately 2.6 seconds). That is, the contents of ADC counter 44 are updated for each copy cycle.

In operation, initially each of the registers PAT1 and PAT2 is loaded with binary patterns equivalent to the hexadecimal number FF as seen in FIG. 8. FIG. 8, represents the binary digit contents of the registers PAT1 and PAT2 during successive stages of the procedure illustrated in FIG. 7. The top two registers show eight 1 bits in each register illustrating hexadecimal numbers FF.

The first decision block, in FIG. 7, is ADC greater than 62. The total range of ADC counter 44 is 0–63. If the contents of the ADC counter 44 represent a number greater than 62, there will be no missed or stolen cycles of line voltage across the fuser heat lamp 74 because each bit location in the registers PAT1 and PAT2 contains a 1 bit. This is represented by the loop FF, FF 16/16. Each bit location in the registers PAT1 and PAT2 represents a full cycle of input line voltage. A 1 bit represents true or on, that is, a full cycle of input line voltage across fuser heat lamp 74. A 0 bit represents false or off, that is, no input voltage across lamp 74 for a complete input voltage cycle. The two registers PAT1 and PAT2 together represent a 16 bit register R providing control of 16 full cycles of input voltage. However, the bits are rotated serially one bit at a time every full cycle around this combined register to provide continuous control during the fusing cycle according to the patterns in registers PAT1 and PAT2.

Essentially, the data bits are shifted from the register R including PAT1 and PAT2 to the octal latch 68*a*. Each bit is shifted to the next higher bit position and the bit in the highest position is rotated to the lowest bit position such that after 16 bits have been serially rotated through the register, the process repeats with the initial bit pattern stored in the two registers PAT1 and PAT2. The values in PAT1 PAT2 may be modified once per copy cycle if the input voltage changes. This sequence continues to the end of the fuse operation. The triac 78 responds to each bit for a complete input cycle, that is either enabled or not enabled for a complete input cycle.

Returning to FIG. 7, if the contents of ADC 42 represent a number less than 63, the binary number equivalent to hexidecimal number FE is stored in the register PAT1, as represented in the second box in column 2 of FIG. 8. The second decision level or block ADC greater than 54 must next be satisfied. If the number is greater than 54, then the triac 78 will be activated in accordance with the patterns shown in the second row of registers in FIG. 8. Since there is a zero in one of the bit positions, there will be an activation of the triac 78 of only 15 of the total 16 cycles of input line voltage as represented by 15/16.

The sequence continues if ADC is less than 55 to find the appropriate loop and activation rate of triac 78 as determined by the contents of ADC counter 44. If the number is 6, the sequence continues through decision blocks ADC 44 greater than 54, greater than 46, greater than 37, greater than 30, greater than 20, and greater than 7 to set PAT2 with pattern AA and PAT1 with pattern D6 for a 9/16 activation rate. At each step the contents of at least one of the registers PAT1, PAT2 is changed to provide a different activation pattern as required.

If, for example, the ADC reading is less than 55, but greater than 46 the binary number equivalent of hexidecimal FE will be stored in register PAT2, FE already having been stored in PAT1, to provide an enabling signal for 14 out of 16 input voltage cycles. Similarly, the contents of ADC counter 44 manifesting a number 38 through 46 provides a 13/16 activation rate provided by the binary number equivalent to hexidecimal FD having been stored in PAT2 and hexidecimal number DE stored in PAT1. Binary numbers equivalent to hexidecimal EE are stored in both PAT1 and PAT2 in response to an ADC 44 reading of 31 through 38 providing a 12/16 enabling rate.

It should be noted that the maximum rate 16/16 of activation occurs because of a relatively low or minimum input voltage RMS and the low activation rate for example, 9/16 occurs because of a relatively high input voltage RMS necessitating cycle stealing in order to provide the relative constant average 101 RMS voltage across the fuser heat lamp 74. FIG. 7 represents the procedure followed after sensing the voltage $V_{IN}$ to provide an activation rate of fusing for a particular copy cycle. For the next copy cycle, another voltage $V_{IN}$ will be sensed and may result in a different fusing rate for that particular copy cycle. However, during a particular copy cycle, the activation rate of fuser triac 78 remains constant.

Although, for a given activation rate, the voltage applied across the fuser heat lamp 74 can vary, the variance is within acceptable limits. For example, a ADC counter 44 manifesting a number 55 or 62 determines a 15/16 activation rate. At this activation rate, the number 62 represents an input line voltage of 103.5 RMS resulting in an average voltage across the lamp of 100.2 volts RMS. The number 55 represents 106.5 input line volts RMS providing an average voltage across the lamp of 103.1 volts RMS. Although there is a 2.9 voltage variation, the limits of the range are well within the 101±2.5 volt specification.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

What is claimed is:

1. In an apparatus for producing copies of documents, the apparatus having a fuser for fixing images produced on the copies and a heater for heating the fuser, the combination of, a triac to control voltage to the heater, the triac in a first state providing voltage to the heater and in a second interrupting voltage to the heater; and a control for operating the triac including a low voltage power supply connected to input line voltage;

dedicated fuser circuitry connected to the low voltage power supply and providing a stabilized reference voltage and a sample voltage, the sample voltage representing input line voltage;

a microprocessor including a gate activation register;

a comparator and analog to digital converter responsive to the reference voltage and the sample voltage providing a digital signal equivalent of the sample voltage; and means to selectively gate the triac in response to the digital signal equivalent and the gate activation register to regulate the voltage across the heater.

2. A controller for the fuser of a reproduction machine for regulating the electrical input to the fuser comprising:

a power source for the fuser;

a switch for selectively connecting the fuser to the power source;

fuser circuitry connected to the power source and providing a power source sample signal;

digitizing means for providing a digital signal equivalent of the sample signal; and control means including a microprocessor including a gate activation register responsive to the digital signal equivalent and the gate activation register to selectively gate the switch to regulate the electrical input to the fuser wherein the fuser circuitry provides a stabilized reference voltage and the digitizing means includes a digital counter, an analog comparator and a resistor network, the resistor network responsive to the digital counter and the stabilized reference voltage to provide an analog input signal to the voltage comparator, a second input to the analog comparator being the sample signal, the output of the digital counter representing the digital equivalent of the sample signal.

3. In a reproduction machine having a fuser and a controller including a microprocessor having a counter and a binary pattern register, the fuser connected across input line voltage by activation of a triac, the method of controlling the operation of the fuser including the steps of:

providing a transformer isolated sample of the input line voltage;

rectifying the sample to produce a direct current input to the machine controller;

providing a stabilized reference voltage to the machine controller;

producing a digital equivalent of the sample voltage in response to the direct current input and the stabilized reference voltage;

storing at least one bit pattern in the pattern register;

determining the rate of activation of the triac in response to the digital equivalent; and activating the triac corresponding to said at least one bit pattern in accordance with the determined rate in order to provide a relative constant input line voltage across the fuser.

4. A method of controlling the fuser of a reproduction machine to provide a relatively constant average input voltage to the fuser, the fuser electrically connected to an input voltage and a gating device, to control the input voltage across the fuser, the method comprising the steps of:

providing a transformer isolated sample of the input voltage, providing a stabilized reference voltage, in response to the sample voltage and reference voltage, providing a digital signal equivalent of the sample voltage, storing a gate activation pattern in a register;

determining the rate of activation of the gate in response to the digitized signal to provide the relatively constant average input voltage across the fuser, and activating the gate in accordance with the determined rate corresponding to the stored gate activation pattern.

5. The method of claim 4 wherein the input voltage to the fuser varies from a minimum RMS voltage to a maximum RMS voltage at a given frequency and at or below minimum RMS voltage, the gate is activated to provide voltage across the fuser for each cycle of the input voltage.

6. The method of claim 5 wherein at an RMS voltage greater than minimum, the gate is activated to inhibit selected cycles of input voltage across the fuser.

7. The method of claim 6 including the method of providing a plurality of rates of activation of the gate, each rate corresponding to a predetermined range of digital signals, determining the range related to a particular digital signal, and activating the gate according to the rate related to the determined range of the corresponding digital signal.

8. The method of claim 7 wherein the range of digital signals corresponds to a range of variance of the input voltage.

9. The method of claim 4 wherein the step of determining the rate of activation of the gate includes the steps of providing a plurality of ranges of said digital signals extending from a minimum digital signal to a maximum digital signal.

providing a gate activation rate corresponding to each of the plurality of ranges of digital signals identifying the range corresponding to the digital signal provided and activating the gate according to the rate corresponding to the range of the digital signal provided.

10. The method of claim 9 including the step of providing a digital signal equivalent for each copy cycle of the reproduction machine.

* * * * *